US007798153B2

(12) United States Patent
Lawrence, Jr.

(10) Patent No.: US 7,798,153 B2
(45) Date of Patent: Sep. 21, 2010

(54) ***NICOTIANA KAWAKAMII* SMOKELESS TOBACCO**

(75) Inventor: Robert H. Lawrence, Jr., Riverside, CT (US)

(73) Assignee: US Smokeless Tobacco Co., Greenwich, CT (US)

( * ) Notice: Subject to any disclaimer, the term of this patent is extended or adjusted under 35 U.S.C. 154(b) by 984 days.

(21) Appl. No.: 10/981,948

(22) Filed: Nov. 5, 2004

(65) Prior Publication Data

US 2006/0037623 A1 Feb. 23, 2006

Related U.S. Application Data

(60) Provisional application No. 60/603,887, filed on Aug. 23, 2004.

(51) Int. Cl.
*A24B 13/02* (2006.01)

(52) U.S. Cl. ..... 131/352; 131/353

(58) Field of Classification Search ..... 131/352
See application file for complete search history.

(56) References Cited

U.S. PATENT DOCUMENTS

| | | | |
|---|---|---|---|
| 3,710,805 | A | 1/1973 | Tamaki et al. |
| 4,441,514 | A | 4/1984 | Mitchell et al. |
| 4,516,590 | A | 5/1985 | Teng |
| 6,534,527 | B2 | 3/2003 | Wolfson et al. |
| 6,868,855 | B2 | 3/2005 | Shafer et al. |
| 6,911,541 | B2 | 6/2005 | Conkling et al. |
| 2003/0018997 | A1 | 1/2003 | Conkling et al. |
| 2003/0070687 | A1 | 4/2003 | Atchley et al. |
| 2003/0094182 | A1 | 5/2003 | Atchley et al. |
| 2004/0112394 | A1 | 6/2004 | Krukonis et al. |
| 2005/0244521 | A1 | 11/2005 | Strickland et al. |
| 2006/0185686 | A1 | 8/2006 | Lawrence, Jr. |
| 2006/0191548 | A1 | 8/2006 | Strickland et al. |

FOREIGN PATENT DOCUMENTS

| | | |
|---|---|---|
| JP | 2-203775 | 8/1990 |
| JP | 3-266969 | 11/1991 |
| JP | 4-82896 | 3/1992 |
| JP | 6-206894 | 7/1994 |
| JP | 6-211885 | 8/1994 |
| JP | 8-231451 | 9/1996 |
| JP | 2007-502621 | 2/2007 |
| WO | WO 2005/018307 | 3/2005 |
| WO | WO 2005/041699 | 5/2005 |
| WO | WO 2005/046363 | 5/2005 |
| WO | WO 2005/111217 | 11/2005 |
| WO | WO 2006/127772 | 11/2006 |

OTHER PUBLICATIONS

Jackson et al , Potential of *N. Kawakamii* as a trap crop for protecting flue-cured tobacco from damage by *Heliothis virescens* larvae, Journal of Economic Entomology 1998 vol. 91, No. 3, pp. 759-766.*
International Search Report and written opinion from PCT/US04/36795, mailed Feb. 9, 2005.
International Search Report from PCT/US07/02217, mailed Oct. 25, 2007.
Colin Browne, *The Design of Cigarettes* (Celanese Fibers Marketing Co., 1981), pp. 26-27.
Office Action for U.S. Appl. No. 11/344,033, dated Feb. 3, 2009.
Office Action for U.S. Appl. No. 11/344,033, dated Feb. 1, 2010.
Notice of Reasons for Rejection for Japanese Patent Application No. 2007-529805, drafted Jun. 15, 2010, dispatch date Jun. 17, 2010.
English Translation of Notice of Reasons for Rejection for Japanese Patent Application No. 2007-529805, drafted Jun. 15, 2010, dispatch date Jun. 17, 2010.

* cited by examiner

*Primary Examiner*—Carlos Lopez
(74) *Attorney, Agent, or Firm*—Clark & Elbing LLP

(57) ABSTRACT

The invention features a blended smokeless tobacco composition that includes two of the following tobaccos: *Nicotiana acaulis, Nicotiana acuminata, Nicotiana acuminata* var. *multiflora, Nicotiana africana, Nicotiana alata, Nicotiana amplexicaulis, Nicotiana arentsii, Nicotiana attenuata, Nicotiana benavidesii, Nicotiana benthamiana, Nicotiana bigelovii, Nicotiana bonariensis, Nicotiana cavicola, Nicotiana clevelandii, Nicotiana cordifolia, Nicotiana corymbosa, Nicotiana debneyi, Nicotiana excelsior, Nicotiana forgetiana, Nicotiana fragrans, Nicotiana glauca, Nicotiana glutinosa, Nicotiana goodspeedii, Nicotiana gossei, Nicotiana hybrid, Nicotiana ingulba, Nicotiana kawakamii, Nicotiana knightiana, Nicotiana langsdorffii, Nicotiana linearis, Nicotiana longiflora, Nicotiana maritima, Nicotiana megalosiphon, Nicotiana miersii, Nicotiana noctiflora, Nicotiana nudicaulis, Nicotiana obtusifolia, Nicotiana occidentalis, Nicotiana occidentalis* subsp. *hesperis, Nicotiana otophora, Nicotiana paniculata, Nicotiana pauciflora, Nicotiana petunioides, Nicotiana plumbaginifolia, Nicotiana quadrivalvis, Nicotiana raimondii, Nicotiana repanda, Nicotiana rosulata, Nicotiana rosulata* subsp. *ingulba, Nicotiana rotundifolia, Nicotiana setchellii, Nicotiana simulans, Nicotiana solanifolia, Nicotiana spegazzinii, Nicotiana stocktonii, Nicotiana suaveolens, Nicotiana sylvestris, Nicotiana thyrsiflora, Nicotiana tomentosa, Nicotiana tomentosiformis, Nicotiana trigonophylla, Nicotiana umbratica, Nicotiana undulata, Nicotiana velutina, Nicotiana wigandioides*, and *Nicotiana* x *sanderae.*

7 Claims, No Drawings

*NICOTIANA KAWAKAMII* SMOKELESS TOBACCO

CROSS-REFERENCE TO RELATED APPLICATIONS

This application claims benefit of U.S. Provisional Application No. 60/603,887, filed Aug. 23, 2004, which is hereby incorporated by reference.

FIELD OF THE INVENTION

The present invention relates to the field of compositions that include tobacco.

SUMMARY OF THE INVENTION

The invention features tobacco products that include one or more members of the genus *Nicotiana*. Such products may contain raw or processed tobacco, or alternatively may contain tobacco-derived components, e.g., organoleptic compounds. Tobacco-derived components may be supplied by tobacco particles, a tobacco extract, or a combination thereof.

In one aspect, the invention features a smokeless tobacco composition, e.g. a chewing tobacco, a snuff, a film, or a gel, including tobacco from one of the following members of the *Nicotiana* genus: *Nicotiana acaulis, Nicotiana acuminata, Nicotiana acuminata* var. *multiflora, Nicotiana africana, Nicotiana alata, Nicotiana amplexicaulis, Nicotiana arentsii, Nicotiana attenuata, Nicotiana benavidesii, Nicotiana benthamiana, Nicotiana bigelovii, Nicotiana bonariensis, Nicotiana cavicola, Nicotiana clevelandii, Nicotiana cordifolia, Nicotiana corymbosa, Nicotiana debneyi, Nicotiana excelsior, Nicotiana forgetiana, Nicotiana fragrans, Nicotiana glauca, Nicotiana glutinosa, Nicotiana goodspeedii, Nicotiana gossei, Nicotiana hybrid, Nicotiana ingulba, Nicotiana kawakamii, Nicotiana knightiana, Nicotiana langsdorffii, Nicotiana linearis, Nicotiana longiflora, Nicotiana maritima, Nicotiana megalosiphon, Nicotiana miersii, Nicotiana noctiflora, Nicotiana nudicaulis, Nicotiana obtusifolia, Nicotiana occidentalis, Nicotiana occidentalis* subsp. *hesperis, Nicotiana otophora, Nicotiana paniculata, Nicotiana pauciflora, Nicotiana petunioides, Nicotiana plumbaginifolia, Nicotiana quadrivalvis, Nicotiana raimondii, Nicotiana repanda, Nicotiana rosulata, Nicotiana rosulata* subsp. *ingulba, Nicotiana rotundifolia, Nicotiana setchellii, Nicotiana simulans, Nicotiana solanifolia, Nicotiana spegazzinii, Nicotiana stocktonii, Nicotiana suaveolens, Nicotiana sylvestris, Nicotiana thyrsiflora, Nicotiana tomentosa, Nicotiana tomentosiformis, Nicotiana trigonophylla, Nicotiana umbratica, Nicotiana undulata, Nicotiana velutina, Nicotiana wigandioides*, and *Nicotiana* x *sanderae.*

A composition as described may further include one, two, three, four, five, six, or more auxiliary tobaccos, which are different than the tobacco already present in the smokeless tobacco composition. Auxiliary tobaccos include: *Nicotiana acaulis, Nicotiana acuminata, Nicotiana acuminata* var. *multiflora, Nicotiana africana, Nicotiana alata, Nicotiana amplexicaulis, Nicotiana arentsii, Nicotiana attenuata, Nicotiana benavidesii, Nicotiana benthamiana, Nicotiana bigelovii, Nicotiana bonariensis, Nicotiana cavicola, Nicotiana clevelandii, Nicotiana cordifolia, Nicotiana corymbosa, Nicotiana debneyi, Nicotiana excelsior, Nicotiana forgetiana, Nicotiana fragrans, Nicotiana glauca, Nicotiana glutinosa, Nicotiana goodspeedii, Nicotiana gossei, Nicotiana hybrid, Nicotiana ingulba, Nicotiana kawakamii, Nicotiana knightiana, Nicotiana langsdorffii, Nicotiana linearis, Nicotiana longiflora, Nicotiana maritima, Nicotiana megalosiphon, Nicotiana miersii, Nicotiana noctiflora, Nicotiana nudicaulis, Nicotiana obtusifolia, Nicotiana occidentalis, Nicotiana occidentalis* subsp. *hesperis, Nicotiana otophora, Nicotiana paniculata, Nicotiana pauciflora, Nicotiana petunioides, Nicotiana plumbaginifolia, Nicotiana quadrivalvis, Nicotiana raimondii, Nicotiana repanda, Nicotiana rosulata, Nicotiana rosulata* subsp. *ingulba, Nicotiana rotundifolia, Nicotiana setchellii, Nicotiana simulans, Nicotiana solanifolia, Nicotiana spegazzinii, Nicotiana stocktonii, Nicotiana suaveolens, Nicotiana sylvestris, Nicotiana thyrsiflora, Nicotiana tomentosa, Nicotiana tomentosiformis, Nicotiana trigonophylla, Nicotiana umbratica, Nicotiana undulata, Nicotiana velutina, Nicotiana wigandioides*, and *Nicotiana* x *sanderae.*

Any composition described herein may further include tobacco from *Nicotiana rustica* or *Nicotiana tabacum* (for example, LA B21, LN KY171, TI 1406, Basma, Galpao, Perique, Beinhart 1000-1, and Petico), or both. Compositions are preferably orally consumed. The compositions may further include a flavor, a flavor masking agent, a sweetener, chlorophyll, a mineral, a botanical, or a breath freshening agent.

In another aspect, the invention features a method of providing tobacco satisfaction, by introducing into the mouth any of the compositions, or combinations of compositions, described herein.

By "tobacco" is meant any part of any member of the genus *Nicotiana*, e.g., leaves, flowers, roots, and stems. The tobacco may be whole, shredded, cut, cured, aged, fermented, or otherwise processed. Tobacco may also be in the form of finished products, including but not limited to smokeless tobacco, e.g. snuff (moist or dry) or chewing tobacco. The term also includes an extract of tobacco including two or more tobacco organoleptic components.

By "tobacco satisfaction," in this case, is meant the experience associated with tobacco organoleptic components and added flavor components that are released in the mouth when using a smokeless tobacco. An adult consumer who chooses to use a smokeless tobacco product purchases a smokeless tobacco product typically according to their individual preference, such a preference includes, without limitation, flavor, cut of tobacco, form, ease of use, and packaging.

By "organoleptic" is meant relating or contributing to the integrated sensory perception by the consumer that includes, for example, any combination of aroma, fragrance, flavor, taste, odor, mouth feel, or the like.

Other features and advantages will be apparent from the following description and the claims.

DETAILED DESCRIPTION OF THE INVENTION

The invention features tobacco products including one or more members of the genus *Nicotiana* that may be utilized to obtain tobacco satisfaction.

Tobacco

Tobacco materials are typically provided in various forms such as a dust or powder, cut filler, shreds, strips, stems, or leaves or any combination of such forms. Tobacco material may be expanded to increase its size using standard methods known in the art, e.g., puffing. Such methods are especially useful in expanding stem material. The tobacco material can also be grounded to form finely divided particles. The tobacco material may, if desired, therefore be subjected to various treatments to reduce its size, such as grinding or milling, for producing tobacco material in a finely ground or powder form. The tobacco employed in the composition may also be prepared according to the methods of U.S. Publication No. 2004/0112394, the disclosure of which is hereby incorporated by reference. Preferably, the tobacco material is in finely particulate form; however, grinding before processing is not required. Examples of suitable tobaccos useful for producing a tobacco composition include any raw or processed (or mature or immature) tobacco from the following members of the *Nicotiana* genus: *Nicotiana acaulis, Nicotiana acuminata, Nicotiana acuminata* var. *multiflora, Nicotiana africana, Nicotiana alata, Nicotiana amplexicaulis, Nicotiana arentsii, Nicotiana attenuata, Nicotiana benavidesii, Nicotiana benthamiana, Nicotiana bigelovii, Nicotiana bonariensis, Nicotiana cavicola, Nicotiana clevelandii, Nicotiana cordifolia, Nicotiana corymbosa, Nicotiana debneyi, Nicotiana excelsior, Nicotiana forgetiana, Nicotiana fragrans, Nicotiana glauca, Nicotiana glutinosa, Nicotiana goodspeedii, Nicotiana gossei, Nicotiana hybrid, Nicotiana ingulba, Nicotiana kawakamii, Nicotiana knightiana, Nicotiana langsdorffii, Nicotiana linearis, Nicotiana longiflora, Nicotiana maritima, Nicotiana megalosiphon, Nicotiana miersii, Nicotiana noctiflora, Nicotiana nudicaulis, Nicotiana obtusifolia, Nicotiana occidentalis, Nicotiana occidentalis* subsp. *hesperis, Nicotiana otophora, Nicotiana paniculata, Nicotiana pauciflora, Nicotiana petunioides, Nicotiana plumbaginifolia, Nicotiana quadrivalvis, Nicotiana raimondii, Nicotiana repanda, Nicotiana rosulata, Nicotiana rosulata* subsp. *ingulba, Nicotiana rotundifolia, Nicotiana setchellii, Nicotiana simulans, Nicotiana solanifolia, Nicotiana spegazzinii, Nicotiana stocktonii, Nicotiana suaveolens, Nicotiana sylvestris, Nicotiana thyrsiflora, Nicotiana tomentosa, Nicotiana tomentosiformis, Nicotiana trigonophylla, Nicotiana umbratica, Nicotiana undulata, Nicotiana velutina, Nicotiana wigandioides*, and *Nicotiana* x *sanderae*. Any one of these members may be used alone, in combination with each other, or in combination with *Nicotiana tabacum* (for example, LA B21, LN KY171, TI 1406, Basma, Galpao, Perique, Beinhart 1000-1, and Petico) or *Nicotiana rustica*. These species of tobacco are typically processed according to standard methods, e.g., processed separately, or as blends thereof.

Compositions

Tobacco derived from members of the *Nicotiana* genus may be included in any composition. Compositions may include, without limitation, a smokeless tobacco product, such as snuff (moist or dry) or a smokeless tobacco product made from an extract of cured or uncured tobacco, chewing tobacco, films, or gels. Exemplary compositions are described in U.S. Publication Nos. 2003/0094182 and 2003/0070687, U.S. Ser. Nos. 60/518,352, 60/603,888, and U.S. Ser. No. 10/982,248, filed Nov. 5, 2004, entitled "Tobacco Compositions" the disclosures of which are hereby incorporated by reference.

In an important aspect, the tobacco used in the composition may be any tobacco described above. Suitable tobaccos include fermented and unfermented tobaccos, cured (such as air-, fire-, or flue-cured), light or dark fired, as well as the products from whole leaf stemming operation. Alternatives and variations include the use of tobacco leaf or lamina and stem. In addition, scrap size tobacco lamina may be commingled with homogenized product for the purpose of modifying the texture and flavor.

Any tobacco described herein may be mixed with other additives known in the tobacco art. Compositions of the invention may therefore include flavor extracts (e.g., licorice, kudzu, hydrangea, Japanese white bark magnolia leaf, chamomile, fenugreek, clove, menthol, Japanese mint, aniseed, cinnamon, herb, wintergreen, apple, peach, cherry, berry, Dramboui, bourbon, scotch, whiskey, spearmint, peppermint, lavender, cardamon, apium graveolens, cascarilla, nutmeg, sandalwood, bergamot, geranium, honey essence, rose oil, vanilla, lemon oil, orange oil, cassia, caraway, cognac, jasmin, ilangilang, sage, fennel, piment, ginger, anise, coriander, coffee, or a mint oil from any species of the genus *Mentha*), flavor masking agents, bitterness receptor site blockers, sweeteners (e.g., sucralose, acesulfame potassium (Ace-K), aspartame, saccharine, cyclamates, lactose, sucrose, glucose, fructose, sorbitol, and mannitol), and other desirable additives such as chlorophyll, minerals, botanicals, or breath freshening agents.

Flavors may also be provided by plant matter, e.g., mint leaves, which are typically 10% flavor oils and 90% insoluble fiber. Exemplary plants further include licorice, kudzu, hydrangea, Japanese white bark magnolia, chamomile, fenugreek, clove, Japanese mint, cinnamon, herb, apple, peach, cherry, berry, lavender, cardamon, apium graveolens, cascarilla, nutmeg, sandalwood, bergamot, geranium, rose, vanilla, lemon, orange, cassia, caraway, jasmin, ilangilang, sage, fennel, piment, ginger, anise, coriander, coffee, or any species of the genus *Mentha*.

Flavor may be provided to a composition as described herein by flavor extracts, plant matter, or a combination thereof. In addition to natural flavor extracts, flavor may also be provided by imitation, synthetic, or artificial flavor ingredients and blends containing such ingredients. Flavors may be added as a powder, an oil, or in encapsulated form.

Tobacco compositions may, if desired, be used to provide flavor or aroma or both to virtually any smokeless tobacco composition including, but not limited to, snuff (moist or dry), chewing tobacco, loose tobacco, pouched tobacco, and the like, or any form contained herein.

To produce a tobacco composition, any of the above-referenced tobaccos is first grown and harvested. The tobacco plant or a component thereof is, if desired, aged, fermented, or cured according to methods known in the art. Plant material may be processed according to standard methods known in the art for the production of a tobacco composition, e.g., stripped, bailed, redried, cut, conditioned, extruded, or blended.

Any of the aforementioned tobaccos may be used to produce a composition. A composition may also include a blend of any of the aforementioned tobaccos described herein. In particular, such tobacco plant material (e.g., *Nicotiana acauli* and *Nicotiana acuminata, Nicotiana acuminata* var. *multiflora* and *Nicotiana africana, Nicotiana alata* and *Nicotiana amplexicaulis, Nicotiana arentsii* and *Nicotiana attenuata, Nicotiana benavidesii* and *Nicotiana benthamiana, Nicotiana bonariensis* and *Nicotiana cavicola* and *Nicotiana clevelandii*, and *Nicotiana cordifolia* and *Nicotiana corymbosa*) is blended to a desired composition that does not have certain negative flavor characteristics sometimes associated with tobacco. Such "negative flavor characteristics" refers to bitterness, astringency, acridness, harsh tobacco flavor, aftertaste, and negative sensations experienced by consumption. Definitions of flavor characteristics are provided, for example, in The Dictionary of Flavors, DeRovira, Food & Nutrition Press, Inc., 1999, which is incorporated herein by reference.

In one aspect, a blend of any of the tobaccos referred to herein may include the following ranges of a first tobacco and an auxiliary tobacco.

TABLE I

| Weight % First Tobacco | Weight % Second Tobacco |
|---|---|
| 95.0 | 5.0 |
| 90.0 | 10.0 |
| 85.0 | 15.0 |
| 80.0 | 20.0 |
| 75.0 | 25.0 |
| 70.0 | 30.0 |
| 65.0 | 35.0 |
| 60.0 | 40.0 |
| 55.0 | 45.0 |
| 50.0 | 50.0 |
| 45.0 | 55.0 |
| 40.0 | 60.0 |
| 35.0 | 65.0 |
| 30.0 | 70.0 |
| 25.0 | 75.0 |
| 20.0 | 80.0 |
| 15.0 | 85.0 |
| 10.0 | 90.0 |
| 5.0 | 95.0 |

After choosing an appropriate first tobacco and an appropriate auxiliary tobacco (for example, a second, third, fourth, fifth, or sixth tobacco), such tobaccos may be chopped or ground to appropriate sizes depending on the type of product being made. The material may also be further separated based on size by passing it over a screen. Chopping or grinding of the tobaccos may be accomplished using any methods known in the art for that purpose.

The tobaccos that have been appropriately processed are then blended together using methods and equipment known in the art. Other known additives may be blended with the tobaccos either before or after the tobaccos are blended together. The tobaccos may be further processed separately before they are mixed together or further processed together after mixing.

The present invention is more fully illustrated by the following examples, which are set forth to illustrate the present invention and are not to be construed as limiting.

EXAMPLES

Example 1

Air cured tobacco, *Nicotiana acaulis*, is made from aged air cured leaf that is ground in a Whiley Mill using a 4 mm screen. Tobacco material is collected. An oven volatile is next run on the tobacco to determine its moisture content. This value is then used to calculate needed RO water amount to bring the tobacco to 30 percent moisture.

Example 2

Air cured tobacco, *Nicotiana acuminata*, is made from aged air cured leaf that is ground in a Whiley Mill using a 4 mm screen. Tobacco material is collected. An oven volatile is next run on the tobacco to determine its moisture content. This value is then used to calculate needed RO water amount to bring the tobacco to 30 percent moisture.

Example 3

Air cured tobacco, *Nicotiana acuminata* var. *multiflora*, is made from aged air cured leaf that is ground in a Whiley Mill using a 4 mm screen. Tobacco material is collected. An oven volatile is next run on the tobacco to determine its moisture content. This value is then used to calculate needed RO water amount to bring the tobacco to 30 percent moisture.

Example 4

Air cured tobacco, *Nicotiana africana*, is made from aged air cured leaf that is ground in a Whiley Mill using a 4 mm screen. Tobacco material is collected. An oven volatile is next run on the tobacco to determine its moisture content. This value is then used to calculate needed RO water amount to bring the tobacco to 30 percent moisture.

Example 5

Air cured tobacco, *Nicotiana alata*, is made from aged air cured leaf that is ground in a Whiley Mill using a 4 mm screen. Tobacco material is collected. An oven volatile is next run on the tobacco to determine its moisture content. This value is then used to calculate needed RO water amount to bring the tobacco to 30 percent moisture.

Example 6

Air cured tobacco, *Nicotiana amplexicaulis*, is made from aged air cured leaf that is ground in a Whiley Mill using a 4 mm screen. Tobacco material is collected. An oven volatile is next run on the tobacco to determine its moisture content. This value is then used to calculate needed RO water amount to bring the tobacco to 30 percent moisture.

Example 7

Other tobaccos such as *Nicotiana arentsii, Nicotiana attenuata, Nicotiana benavidesii, Nicotiana benthamiana, Nicotiana bigelovii, Nicotiana bonariensis, Nicotiana cavicola, Nicotiana clevelandii, Nicotiana cordifolia, Nicotiana corymbosa, Nicotiana debneyi, Nicotiana excelsior, Nicotiana forgetiana, Nicotiana fragrans, Nicotiana glauca, Nicotiana glutinosa, Nicotiana goodspeedii, Nicotiana gossei, Nicotiana hybrid, Nicotiana ingulba, Nicotiana kawakamii, Nicotiana knightiana, Nicotiana langsdorffii, Nicotiana linearis, Nicotiana longiflora, Nicotiana maritima, Nicotiana megalosiphon, Nicotiana miersii, Nicotiana noctiflora, Nicotiana nudicaulis, Nicotiana obtusifolia, Nicotiana occidentalis, Nicotiana occidentalis* subsp. *hesperis, Nicotiana otophora, Nicotiana paniculata, Nicotiana pauciflora, Nicotiana petunioides, Nicotiana plumbaginifolia, Nicotiana quadrivalvis, Nicotiana raimondii, Nicotiana repanda, Nicotiana rosulata, Nicotiana rosulata* subsp. *ingulba, Nicotiana rotundifolia, Nicotiana setchellii, Nicotiana simulans, Nicotiana solanifolia, Nicotiana spegazzinii, Nicotiana stocktonii, Nicotiana suaveolens, Nicotiana sylvestris, Nicotiana thyrsiflora, Nicotiana tomentosa, Nicotiana tomentosiformis, Nicotiana trigonophylla, Nicotiana umbratica, Nicotiana undulata, Nicotiana velutina, Nicotiana wigandioides*, and *Nicotiana* x *sanderae* are air-cured and then processed according to according to any of the aforementioned Examples 1-5.

Example 8

Air cured tobacco, *Nicotiana acaulis*, is made from aged air cured leaf that is ground in a Whiley Mill using a 4 mm screen. The same exact setting is used to grind a second air cured tobacco, *Nicotiana acuminata*. An oven volatile is then run on each tobacco to determine its moisture content. Results from these studies are then used to calculate the needed RO water amount to bring the blend to 30 percent moisture. A range of blends is made over the course of several weeks and submitted to a taste panel. The ranges include 5, 10, 15, 20, 40, 60, and 80 percent *Nicotiana acuminata* relative to *Nicotiana acaulis*. Each panelist receives a paired set of the blended samples and the placebo of the respective percentage as it was blended and is asked to evaluate within 2 days to eliminate any possibility of product age differences.

The placebo composition is a respective percentage blend of tobacco and cellulose. The cellulose is washed, dried, and compacted. The cellulose is used commercially as a flavor carrier. The specific characteristics of the cellulose is such that minimal flavor is introduced to the mixture by the cellulose itself.

During a blinded study, taste panels are asked to rate flavor characteristics such as tobacco satisfaction, bitterness, astringency, acridness, and tobacco aftertaste, and indicate their sample preference. A rating of 1 is considered poor as a rating of 10 is considered good.

OTHER EMBODIMENTS

The description of the specific embodiments of the invention is presented for the purposes of illustration. It is not intended to be exhaustive nor to limit the scope of the invention to the specific forms described herein. Although the invention has been described with reference to several embodiments, it will be understood by one of ordinary skill in the art that various modifications can be made without departing from the spirit and the scope of the invention, as set forth in the claims. All patents, patent applications, and publications referenced herein are hereby incorporated by reference.

Other embodiments are within the claims.

What is claimed is:

1. A smokeless tobacco composition comprising a cured *Nicotiana kawakamii* plant or a leaf, lamina, or stem thereof.

2. The composition of claim 1, wherein said composition further comprises *Nicotiana tabacum.*

3. The composition of claim 1, wherein said composition is for oral consumption.

4. The composition of claim 1, wherein said composition is a chewing tobacco, a snuff, a film, or a gel.

5. The composition of claim 1, further comprising a flavor, a flavor masking agent, a sweetener, chlorophyll, a mineral, a botanical, or a breath freshening agent.

6. A method of providing tobacco satisfaction, said method comprising introducing into the mouth the composition of claim 1.

7. The composition of claim 1, wherein said cured *Nicotiana kawakamii* comprises leaf material.

* * * * *